US011754337B2

(12) United States Patent
Noishiki

(10) Patent No.: US 11,754,337 B2
(45) Date of Patent: Sep. 12, 2023

(54) RELIQUEFACTION DEVICE

(71) Applicant: KOBE STEEL, LTD., Hyogo (JP)

(72) Inventor: Koji Noishiki, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 452 days.

(21) Appl. No.: 16/975,986

(22) PCT Filed: Mar. 7, 2019

(86) PCT No.: PCT/JP2019/009009
§ 371 (c)(1),
(2) Date: Aug. 26, 2020

(87) PCT Pub. No.: WO2019/176703
PCT Pub. Date: Sep. 19, 2019

(65) Prior Publication Data

US 2021/0041164 A1 Feb. 11, 2021

(30) Foreign Application Priority Data

Mar. 13, 2018 (JP) ..... 2018-045437

(51) Int. Cl.
*F25J 1/00* (2006.01)
*F25J 5/00* (2006.01)
(Continued)

(52) U.S. Cl.
CPC ..... *F25J 1/0025* (2013.01); *F25J 5/002* (2013.01); *F25J 2210/42* (2013.01);
(Continued)

(58) Field of Classification Search
CPC ..... F17C 2227/0337; F17C 2227/0339; F17C 2227/0341; F17C 2227/0388;
(Continued)

(56) References Cited

U.S. PATENT DOCUMENTS 3,559,722 A * 2/1971 Schauls ..... F25J 5/002 159/16.1
4,330,308 A * 5/1982 Grenier ..... F25J 1/0216 165/166
(Continued)

FOREIGN PATENT DOCUMENTS

JP 2000-146430 A 5/2000

*Primary Examiner* — Eric S Ruppert
*Assistant Examiner* — Hans R Weiland
(74) *Attorney, Agent, or Firm* — Studebaker & Brackett PC

(57) ABSTRACT

Provided is a reliquefaction device with which a gas gasified from a liquid can be efficiently reliquefied. A plurality of flow passages include: a mixing flow passage which is connected to the downstream end section of one among a liquid flow passage and a gas flow passage and allows a fluid mixture to flow so that a reliquefaction promoting liquid flowing through the liquid flow passage and a reliquefaction target gas flowing through the gas flow passage are mixed and the reliquefaction of the reliquefaction target gas is promoted by direct heat exchange; and a gas cooling flow passage which allows a coolant to flow and cool the reliquefaction target gas by indirect heat exchange with the reliquefaction target gas through a separation wall, thereby suppressing the gasification of the reliquefaction promoting liquid when the reliquefaction target gas is mixed with the reliquefaction promoting liquid flowing through the liquid flow passage.

15 Claims, 6 Drawing Sheets

(51) Int. Cl.
*F28D 9/00* (2006.01)
*F28F 3/08* (2006.01)

(52) U.S. Cl.
CPC ..... *F25J 2215/02* (2013.01); *F28D 9/0037* (2013.01); *F28F 3/08* (2013.01)

(58) Field of Classification Search
CPC ..... F17C 2227/039; F17C 2265/03; F17C 2265/033; F17C 2265/034; F17C 2265/037; F25J 1/0025; F25J 1/0221; F25J 5/002; F25J 2215/02; F28D 9/0037; F28F 3/08
See application file for complete search history.

(56) References Cited

U.S. PATENT DOCUMENTS

| | | | | |
|---|---|---|---|---|
| 4,450,903 | A * | 5/1984 | Butt | F28D 9/0068 165/110 |
| 4,646,822 | A * | 3/1987 | Voggenreiter | F25J 5/002 165/DIG. 387 |
| 11,022,377 | B2 * | 6/2021 | Granados | F25J 5/002 |
| 2008/0142204 | A1 * | 6/2008 | Vanden Bussche | F28F 27/02 62/204 |
| 2010/0181053 | A1 * | 7/2010 | Hecht | F25J 5/002 165/164 |
| 2018/0148138 | A1 * | 5/2018 | Shin | F25J 1/0025 |
| 2018/0164051 | A1 * | 6/2018 | Noishiki | F28D 9/00 |
| 2019/0072323 | A1 * | 3/2019 | Felbab | F25J 1/0025 |

* cited by examiner

RELIQUEFACTION DEVICE

TECHNICAL FIELD

The present invention relates to a reliquefaction device configured to reliquefy gas evaporated from liquid.

BACKGROUND ART

When liquid stored in a container is evaporated to generate gas, the total amount of usable liquid decreases. For example, when part of liquefied gas such as liquefied natural gas (LNG) is evaporated in a storage tank to generate boil-off gas, a liquefied gas storage amount decreases. As a result, the total amount of usable liquefied gas decreases.

For this reason, a device configured to reliquefy gas evaporated from liquid has been proposed. For example, Patent Document 1 discloses a device configured to reliquefy, after boil-off gas has been cooled by mixing of liquefied natural gas with the boil-off gas, the cooled boil-off gas by means of cold energy of the liquefied natural gas in a boil-off gas liquefier.

CITATION LIST

Patent Document

Patent Document 1: JP 2000-146430 A

SUMMARY OF THE INVENTION

In the device described in Patent Document 1, there is a problem that it is difficult to efficiently perform reliquefaction of the boil-off gas. That is, when the liquefied natural gas and the boil-off gas are mixed together upon reliquefaction of the boil-off gas, the liquefied natural gas is evaporated due to heat of the boil-off gas. For preventing such evaporation, a large amount of liquefied natural gas to be mixed with the boil-off gas needs to be prepared, and the liquefied natural gas and the boil-off gas need to be slowly mixed together. For this reason, it is difficult to efficiently reliquefy the boil-off gas in the device described in Patent Document 1.

An object of the present invention is to provide a reliquefaction device capable of efficiently reliquefying gas evaporated from liquid.

Provided is, according to the present invention, a reliquefaction device for reliquefying first target gas, which is gas evaporated from liquid and a reliquefaction target, by direct heat exchange between the first target gas and first promoting liquid, which is the liquid to be mixed with the first target gas and which promotes reliquefaction of the first target gas, by mixing the first target gas and the first promoting liquid. The reliquefaction device includes a flow passage unit configured such that multiple flow passages allowing the flow of fluid containing at least one of the first target gas or the first promoting liquid are formed. The flow passage unit includes multiple flow passage substrates joined to each other in a state in which the flow passage substrates are stacked on each other in a predetermined direction, and at at least one of overlapping surfaces of two of the multiple flow passage substrates overlapping with each other in a stacking direction, multiple grooves extending along the overlapping surfaces and forming at least part of the multiple flow passages are provided. The multiple flow passages include a first liquid flow passage formed to extend along the overlapping surfaces and allowing the flow of the first promoting liquid, a first gas flow passage provided adjacent to the first liquid flow passage through a partition wall present between the first gas flow passage and the first liquid flow passage in the stacking direction, provided independently of the first liquid flow passage, formed to extend along the overlapping surfaces, and allowing the flow of the first target gas, a first connection flow passage formed to extend in the stacking direction and connecting the first liquid flow passage and the first gas flow passage to each other, a first mixing flow passage connected to a downstream end portion of any of the first liquid flow passage and the first gas flow passage, formed to extend along the overlapping surfaces, and allowing flow of a fluid mixture containing the first target gas and the first promoting liquid, and a first cooling flow passage provided adjacent to the first gas flow passage through a separation wall present between the first cooling flow passage and the first gas flow passage in the stacking direction, provided independently of the first gas flow passage, and allowing the flow of refrigerant such that indirect heat exchange between the first target gas and the refrigerant is performed through the separation wall.

DESCRIPTION OF EMBODIMENTS

Hereinafter, embodiments of the present invention will be described in detail with reference to the attached drawings.

First Embodiment

Figure 1:
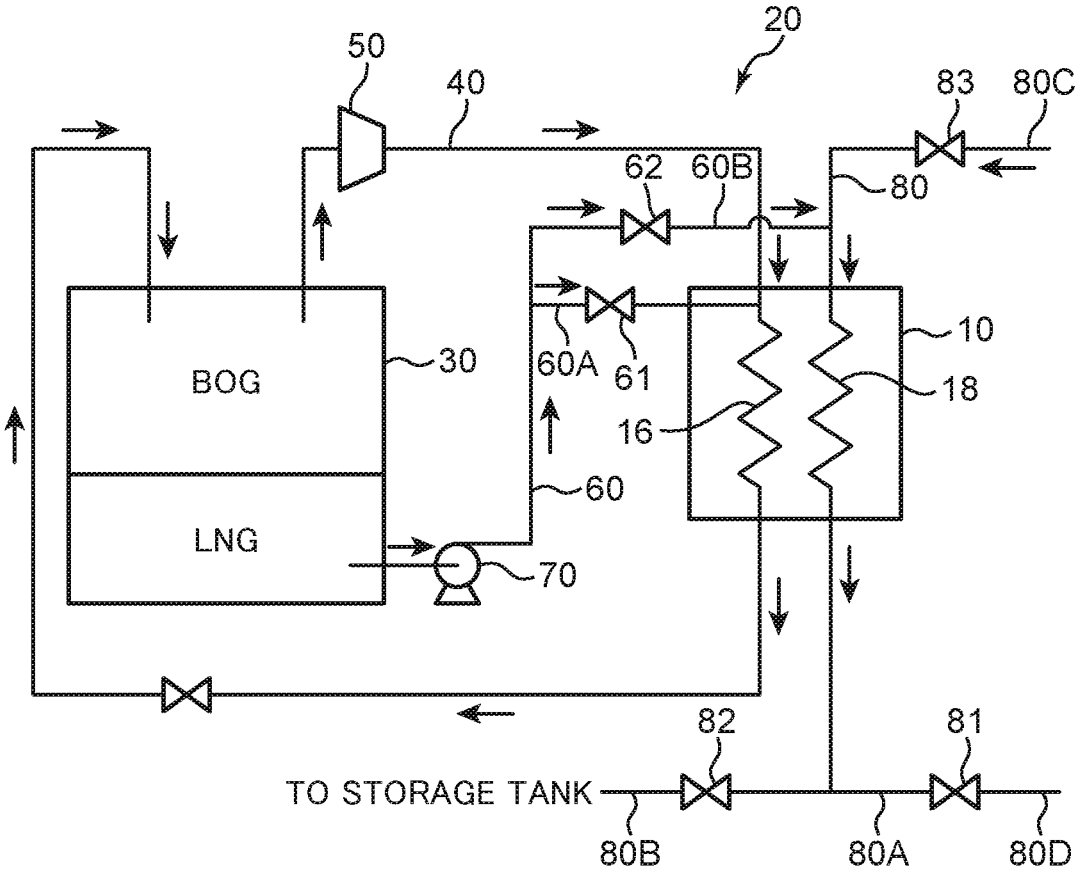
FIG. 1 is a schematic view illustrating an outline configuration of a boil-off gas reliquefaction system including a reliquefaction device according to a first embodiment of the present invention.

A liquefied natural gas reliquefaction system 20 including a reliquefaction device 10 according to a first embodiment of the present invention will be described with reference to FIG. 1. FIG. 1 is a schematic view illustrating an outline configuration of the liquefied natural gas reliquefaction system 20.

The liquefied natural gas reliquefaction system 20 is for reliquefying boil-off gas (BOG) as gas generated by evaporation of liquefied natural gas (LNG) as liquid stored in a storage tank 30.

In the liquefied natural gas reliquefaction system 20, the boil-off gas generated in the storage tank 30 flows in a circulation flow passage 40 connected to the storage tank 30. The boil-off gas flowing in the circulation flow passage 40 is compressed by a compressor 50 provided in the middle of the circulation flow passage 40, and thereafter, is reliquefied by the reliquefaction device 10 provided in the middle of the circulation flow passage 40. The liquefied natural gas generated by reliquefaction of the boil-off gas flows in the circulation flow passage 40, and thereafter, returns to the storage tank 30.

In the liquefied natural gas reliquefaction system 20, the liquefied natural gas stored in the storage tank 30 flows in a supply flow passage 60 connected to the storage tank 30. The liquefied natural gas flowing in the supply flow passage 60 is fed to the outside of the storage tank 30 by a pump 70 provided in the middle of the supply flow passage 60, and thereafter, is supplied to the reliquefaction device 10 and a cooling flow passage 80.

Specifically, the supply flow passage 60 is branched into two flow passages 60A, 60B in the middle. The flow passage 60A is connected to the reliquefaction device 10. A valve 61 is provided in the middle of the flow passage 60A. The valve 61 can switch between the state of supplying the liquefied natural gas to the reliquefaction device 10 and the state of not supplying the liquefied natural gas. The flow passage 60B is connected to the cooling flow passage 80. A valve 62 is provided in the middle of the flow passage 60B. The valve 62 can switch between the state of supplying the liquefied natural gas to the cooling flow passage 80 and the state of not supplying the liquefied natural gas.

The liquefied natural gas supplied to the reliquefaction device 10 performs direct heat exchange with the boil-off gas flowing in the reliquefaction device 10. The liquefied natural gas supplied to the cooling flow passage 80 performs indirect heat exchange with the boil-off gas flowing in the reliquefaction device 10.

Instead of the liquefied natural gas supplied from the storage tank 30 through the supply flow passage 60, e.g., liquefied nitrogen which is at a lower temperature than that of the boil-off gas and which can be used for cooling may flow in the cooling flow passage 80. Specifically, the cooling flow passage 80 is branched into two flow passages 80A, 80B on a downstream side of the reliquefaction device 10 in the middle of the cooling flow passage 80. A valve 81 is provided in the middle of the flow passage 80A. A valve 82 is provided in the middle of the flow passage 80B. The flow passage 80B is connected to the storage tank 30. In a case where refrigerant (one different from the liquefied natural gas) such as the liquefied nitrogen flows in the cooling flow passage 80, the valve 81 provided in the middle of the flow passage 80A is opened and a valve 83 arranged on an upstream side of the cooling flow passage 80 is opened in a state in which the valve 62 provided in the middle of the flow passage 60B and the valve 82 provided in the middle of the flow passage 80B are closed. Thus, while the flow of the refrigerant such as the liquefied nitrogen into the storage tank 30 is prevented, inflow refrigerant through an inlet port 80C is discharged through an outlet port 80D after having passed through the reliquefaction device 10. Note that in a case where the liquefied natural gas flows in the cooling flow passage 80, the valve 81 provided in the middle of the flow passage 80A and the valve 83 are closed in a state in which the valve 62 provided in the middle of the flow passage 60B and the valve 82 provided in the middle of the flow passage 80B are opened.

Figure 2:
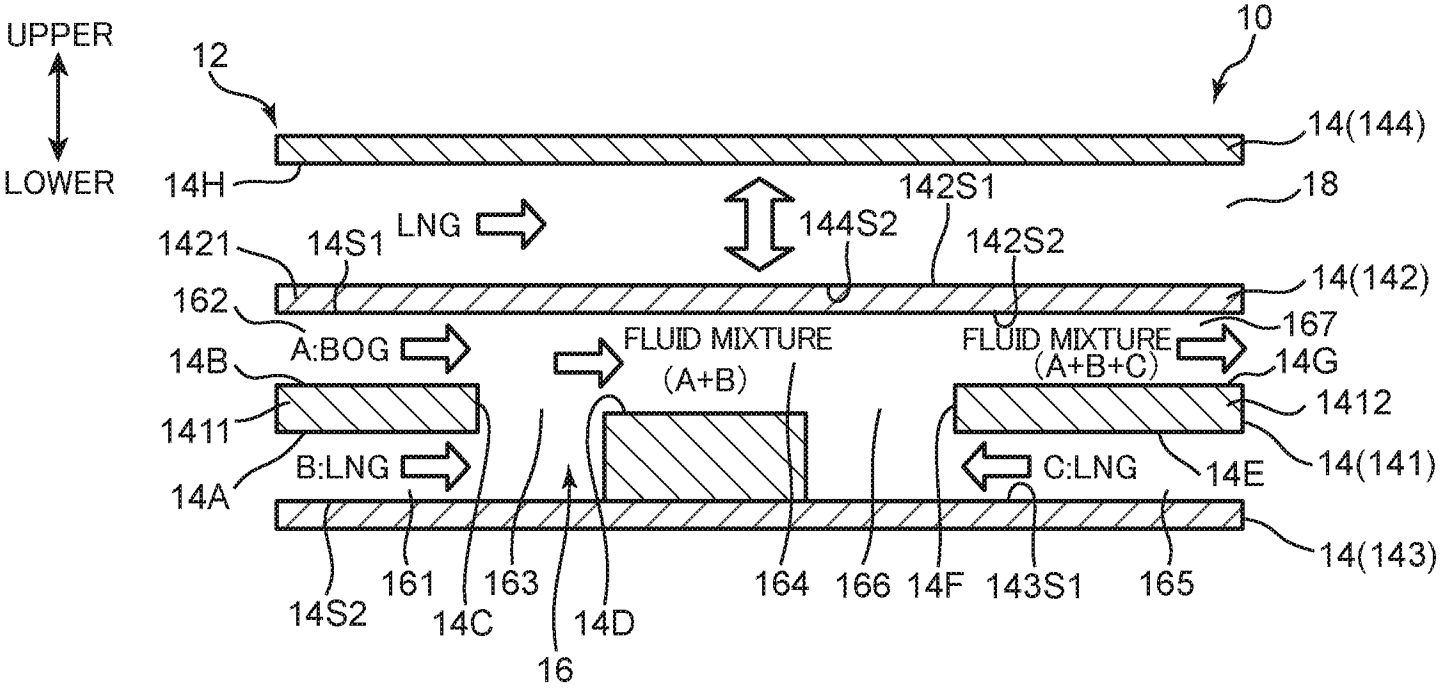
FIG. 2 is a sectional view illustrating an outline configuration of the reliquefaction device according to the first embodiment of the present invention.

The reliquefaction device 10 will be described with reference to FIG. 2. FIG. 2 is a sectional view illustrating an outline configuration of the reliquefaction device 10.

The reliquefaction device 10 is a device configured to reliquefy the boil-off gas as the gas evaporated from the liquefied natural gas as the liquid. The reliquefaction device 10 includes a flow passage unit 12 (a flow passage forming body). In the flow passage unit 12, multiple flow passages allowing the flow of multiple types of fluid including the boil-off gas as gas targeted for reliquefaction and the liquefied natural gas as the liquid for promoting reliquefaction are formed. The flow passage unit 12 has such a structure that multiple flow passage substrates 14 are joined to each other with the flow passage substrates 14 being stacked on each other. At at least one of overlapping surfaces of two of the multiple flow passage substrates 14 overlapping with each other in a stacking direction of the multiple flow passage substrates 14, multiple grooves extending along the overlapping surfaces and forming at least part of the above-described multiple flow passages are provided.

The multiple flow passage substrates 14 include a base substrate 141, a first substrate 142 (a gas flow passage substrate), a second substrate 143 (a fluid flow passage substrate), and a third substrate 144 (a gas cooling flow passage substrate). Note that FIG. 2 illustrates a case where the flow passage unit 12 includes only one substrate group including the base substrate 141, the first substrate 142, the second substrate 143, and the third substrate 144, but the flow passage unit 12 may have such a structure that multiple substrate groups are stacked on each other.

Each of the base substrate 141, the first substrate 142, the second substrate 143, and the third substrate 144 has a rectangular plate shape as a whole. Each of the base substrate 141, the first substrate 142, the second substrate 143, and the third substrate 144 has a first surface positioned on one side (an upper side in FIG. 2) and a second surface positioned on the other side (a lower side in FIG. 2) in the stacking direction (an upper-lower direction in FIG. 2) in which the multiple flow passage substrates 14 are stacked on each other. The base substrate 141, the first substrate 142, the second substrate 143, and the third substrate 144 have the same shape as viewed in plane.

The base substrate 141 has a first overlapping surface 14S1 (a first base overlapping surface) as an overlapping surface including the first surface and a second overlapping surface 14S2 (a second base overlapping surface) as an overlapping surface including the second surface. The first substrate 142 is joined to the base substrate 141 in a state in which an overlapping surface 142S2 including the second surface overlaps with the first overlapping surface 14S1 of the base substrate 141. The second substrate 143 is joined to the base substrate 141 in a state in which an overlapping surface 143S1 including the first surface overlaps with the second overlapping surface 14S2 of the base substrate 141. The third substrate 144 is joined to the first substrate 142 in a state in which an overlapping surface 144S2 including the second surface overlaps with an overlapping surface 142S1 of the first substrate 142 including the first surface.

The multiple flow passages are formed in the flow passage unit 12. The multiple flow passages include multiple fluid flow passages 16 and multiple gas cooling flow passages 18 (first cooling flow passages). The multiple fluid flow passages 16 are flow passages allowing the boil-off gas and the liquefied natural gas to flow as a mixture. The multiple gas cooling flow passages 18 are formed adjacent to the multiple fluid flow passages 16 in the stacking direction of the multiple flow passage substrates 14, and allow a refrigerant flow.

The multiple fluid flow passages 16 are formed to extend in parallel with each other. The multiple fluid flow passages 16 include an LNG flow passage 161 (a first liquid flow passage) as a liquid flow passage, a BOG flow passage 162 (a first gas flow passage) as a gas flow passage, a connection flow passage 163 (a first connection flow passage), a mixing flow passage 164 (a first mixing flow passage), an LNG flow passage 165 (a second liquid flow passage, an additional LNG flow passage) as an additional liquid flow passage, a connection flow passage 166 (a second connection flow passage, an additional mixing connection flow passage), and a mixing flow passage 167 (a second mixing flow passage, a liquid-added mixing flow passage).

The liquefied natural gas as reliquefaction promoting liquid (first promoting liquid) flows in the LNG flow passage 161. That is, an upstream end of the LNG flow passage 161 is connected to the supply flow passage 60 in which the liquefied natural gas stored in the storage tank 30 flows. The LNG flow passage 161 is formed to extend in a direction perpendicular to the stacking direction (the upper-lower direction in FIG. 2) of the multiple flow passage substrates 14, i.e., to extend along the overlapping surfaces of the flow passage substrates 14.

Figure 3:
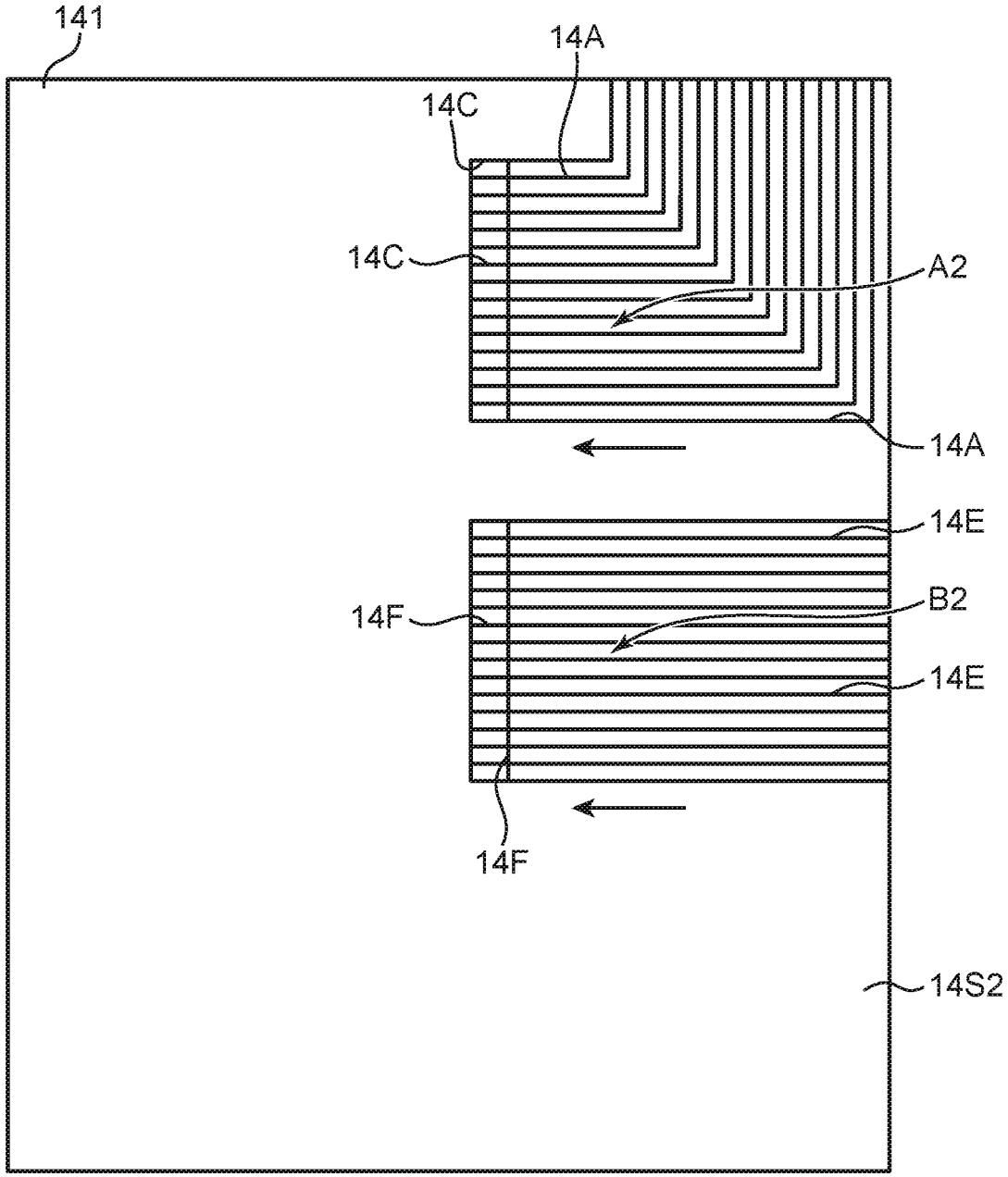
FIG. 3 is a plan view illustrating the state of a base substrate of multiple substrates included in the reliquefaction device illustrated in FIG. 2 from a lower side in a stacking direction of the multiple substrates illustrated in FIG. 2.
Figure 4:
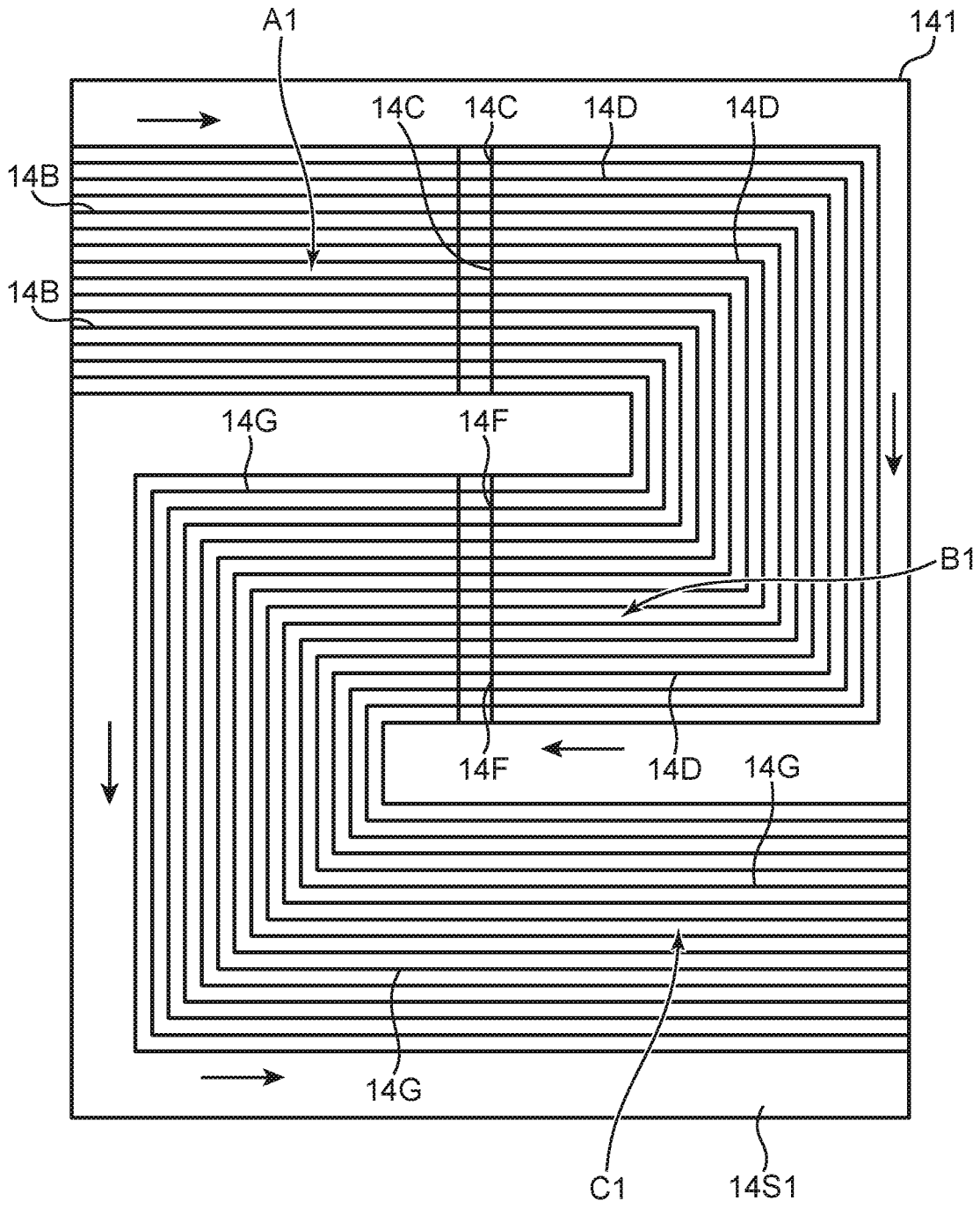
FIG. 4 is a plan view of the state of the base substrate of the multiple substrates included in the reliquefaction device illustrated in FIG. 2 from an upper side in the stacking direction of the multiple substrates illustrated in FIG. 2.
Figure 5:
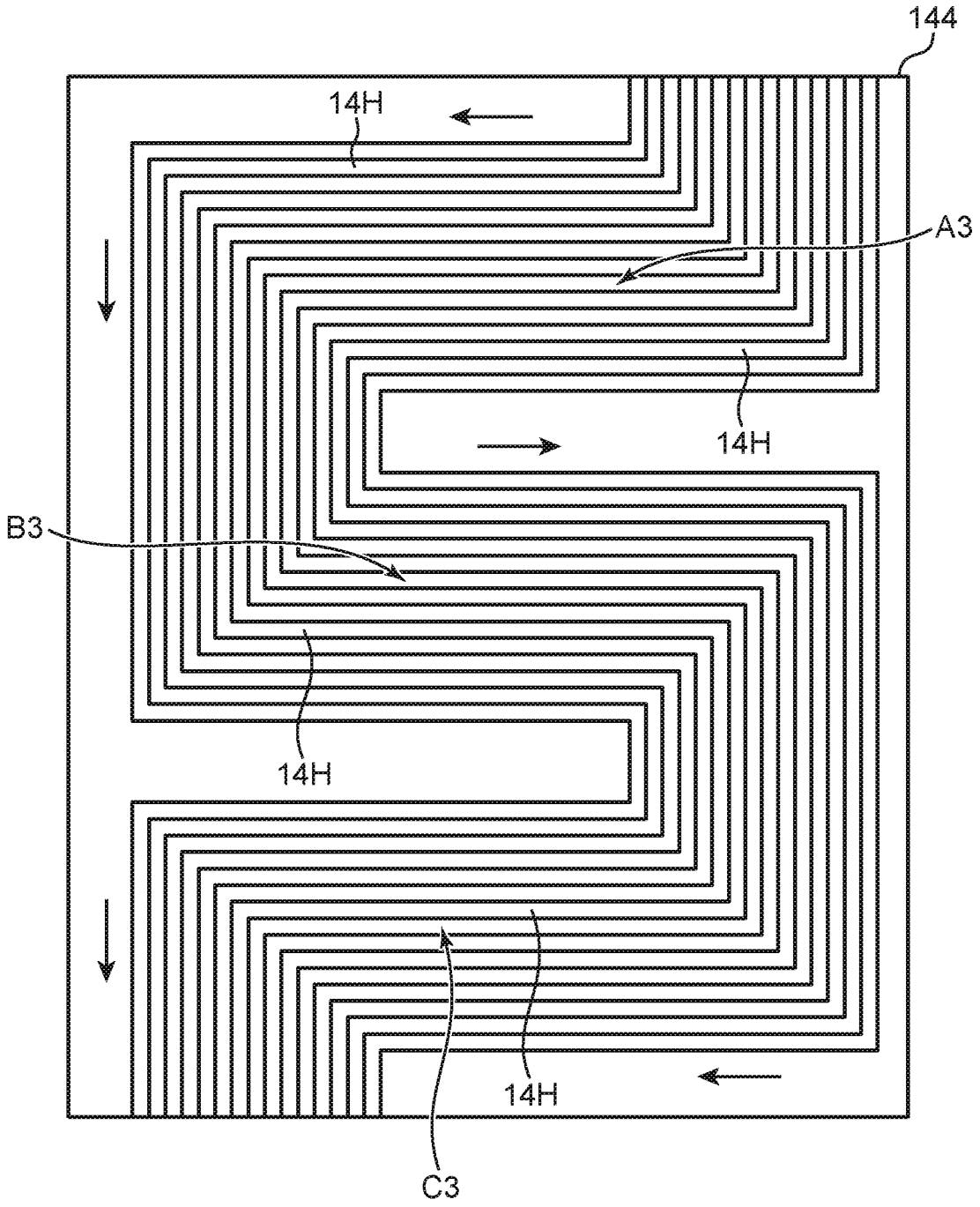
FIG. 5 is a plan view illustrating the state of a third substrate of the multiple substrates included in the reliquefaction device illustrated in FIG. 2 from the lower side in the stacking direction of the multiple substrates illustrated in FIG. 2.

FIG. 3 is a plan view illustrating the state of the base substrate 141 of the multiple flow passage substrates 14 included in the reliquefaction device 10 illustrated in FIG. 2 from the lower side in the stacking direction of the multiple flow passage substrates 14 illustrated in FIG. 2. FIG. 4 is a plan view illustrating the state of the base substrate 141 of FIG. 2 from the upper side in the stacking direction of the multiple flow passage substrates 14 illustrated in FIG. 2. FIG. 5 is a plan view illustrating the state of the third substrate 144 of FIG. 2 from the lower side in the stacking direction of the multiple flow passage substrates 14 illustrated in FIG. 2. Note that a back side of a region A1 of the base substrate 141 in FIG. 4 corresponds to a region A2 of FIG. 3, and a back side of a region B1 of the base substrate 141 in FIG. 4 corresponds to a region B2 of FIG. 3. Moreover, regions A3, B3, C3 of the third substrate 144 of FIG. 5 are each arranged to face the regions A1, B1, C1 of the base substrate 141 of FIG. 4.

As illustrated in FIG. 3, the LNG flow passage 161 is defined by an LNG flow passage groove 14A (a first liquid flow passage groove) as a liquid flow passage groove opening at the second overlapping surface 14S2 of the base substrate 141 and formed to extend along the second overlapping surface 14S2. Specifically, the LNG flow passage 161 is formed in such a tunnel shape that an opening (an opening formed at the second overlapping surface 14S2 of the base substrate 141) of the LNG flow passage groove 14A is covered with the second substrate 143 in a state in which the base substrate 141 and the second substrate 143 are joined to each other. As another expression, the LNG flow passage 161 is defined between an inner surface of the LNG flow passage groove 14A and the overlapping surface of the second substrate 143. Note that it is enough to form the LNG flow passage groove 14A at at least one of the base substrate 141 or the second substrate 143.

The boil-off gas as reliquefaction target gas (first target gas) evaporated from the liquefied natural gas flows in the BOG flow passage 162 as the gas flow passage. That is, an upstream end of the BOG flow passage 162 is connected to the circulation flow passage 40 in which the boil-off gas generated in the storage tank 30 flows. The BOG flow passage 162 is formed adjacent to the LNG flow passage 161 in the stacking direction (the upper-lower direction in FIG. 2) of the multiple flow passage substrates 14. The BOG flow passage 162 is formed to extend in a direction perpendicular to the stacking direction (the upper-lower direction in FIG. 2) of the multiple flow passage substrates 14, i.e., to extend along the overlapping surfaces of the flow passage substrates 14.

As illustrated in FIG. 4, the BOG flow passage 162 is defined by a BOG flow passage groove 14B (a first gas flow passage groove) as a gas flow passage groove opening at the first overlapping surface 14S1 of the base substrate 141 and formed to extend along the first overlapping surface 14S1. Specifically, the BOG flow passage 162 is formed in such a tunnel shape that an opening (an opening formed at the first overlapping surface 14S1 of the base substrate 141) of the BOG flow passage groove 14B is covered with the first substrate 142 in a state in which the base substrate 141 and the first substrate 142 are joined to each other. As another expression, the BOG flow passage 162 is defined between an inner surface of the BOG flow passage groove 14B and the overlapping surface of the first substrate 142. Note that it is enough to form the BOG flow passage groove 14B at at least one of the base substrate 141 or the first substrate 142.

A partition wall 1411 is present between the LNG flow passage 161 and the BOG flow passage 162. The partition wall 1411 separates the LNG flow passage 161 and the BOG flow passage 162 from each other such that the LNG flow passage 161 and the BOG flow passage 162 are provided independently of each other. The partition wall 1411 is formed by a portion of the base substrate 141 positioned between the LNG flow passage groove 14A and the BOG flow passage groove 14B.

The connection flow passage 163 is formed to extend in the stacking direction (the upper-lower direction in FIG. 2) of the multiple flow passage substrates 14, and connects the LNG flow passage 161 and the BOG flow passage 162 to each other such that the liquefied natural gas flowing in the LNG flow passage 161 and the boil-off gas flowing in the BOG flow passage 162 are mixed together. The connection flow passage 163 connects a downstream end portion of the BOG flow passage 162 and a downstream end portion of the LNG flow passage 161. The liquefied natural gas having flowed in the LNG flow passage 161 flows toward the BOG flow passage 162 in the connection flow passage 163.

As illustrated in FIGS. 3 and 4, the connection flow passage 163 is formed by a mixing hole 14C (a first mixing hole) penetrating the base substrate 141 in the stacking direction (the upper-lower direction in FIG. 2) of the multiple flow passage substrates 14.

A fluid mixture generated by mixing of the liquefied natural gas flowing in the LNG flow passage 161 and the boil-off gas flowing in the BOG flow passage 162 flows in the mixing flow passage 164. The mixing flow passage 164 is connected to the downstream end portion of the BOG flow passage 162 to extend continuously from the BOG flow passage 162. The mixing flow passage 164 is formed to extend in a direction perpendicular to the stacking direction (the upper-lower direction in FIG. 2) of the multiple flow passage substrates 14, i.e., to extend along the overlapping surfaces of the flow passage substrates 14.

As illustrated in FIG. 4, the mixing flow passage 164 is defined by a mixing flow passage groove 14D (a first mixing flow passage groove) opening at the first overlapping surface 14S1 of the base substrate 141 and formed to extend along the first overlapping surface 14S1. Specifically, the mixing flow passage 164 is formed in such a tunnel shape that an opening (an opening formed at the first overlapping surface 14S1 of the base substrate 141) of the mixing flow passage groove 14D is covered with the first substrate 142 in a state in which the base substrate 141 and the first substrate 142 are joined to each other. As another expression, the mixing flow passage 164 is defined between an inner surface of the mixing flow passage groove 14D and the overlapping surface of the first substrate 142. The mixing flow passage groove 14D is, at an upstream end thereof, connected to a downstream end of the BOG flow passage groove 14B forming the BOG flow passage 162. That is, the mixing flow passage groove 14D is formed continuously to the BOG flow passage groove 14B. Note that it is enough to form the mixing flow passage groove 14D at at least one of the base substrate 141 or the first substrate 142.

The liquefied natural gas as additional reliquefaction promoting liquid (second promoting liquid) flows in the LNG flow passage 165 as the additional liquid flow passage. That is, an upstream end of the LNG flow passage 165 is connected to the supply flow passage 60 in which the liquefied natural gas stored in the storage tank 30 flows. The LNG flow passage 165 is formed at the same position as that of the LNG flow passage 161 in the stacking direction (the upper-lower direction in FIG. 2) of the multiple flow passage substrates 14. The LNG flow passage 165 is formed at a position different from that of the LNG flow passage 161 as viewed in plane. The LNG flow passage 165 is formed to extend in a direction perpendicular to the stacking direction of the multiple flow passage substrates 14, i.e., to extend along the overlapping surfaces of the flow passage substrates 14.

As illustrated in FIG. 3, the LNG flow passage 165 is defined by an LNG flow passage groove 14E (a second liquid flow passage groove, an additional liquid flow passage groove) opening at the second overlapping surface 14S2 of the base substrate 141 and formed to extend along the second overlapping surface 14S2. Specifically, the LNG flow passage 165 is formed in such a tunnel shape that an opening (an opening formed at the second overlapping surface 14S2 of the base substrate 141) of the LNG flow passage groove 14E is covered with the second substrate 143 in a state in which the base substrate 141 and the second substrate 143 are joined to each other. As another expression, the LNG flow passage 165 is defined between an inner surface of the LNG flow passage groove 14E and the overlapping surface of the second substrate 143. Note that it is enough to form the LNG flow passage groove 14E at at least one of the base substrate 141 or the second substrate 143.

The connection flow passage 166 is formed to extend in the stacking direction (the upper-lower direction in FIG. 2) of the multiple flow passage substrates 14, and connects the mixing flow passage 164 and the LNG flow passage 165 to each other such that the fluid mixture (i.e., the mixed fluid of the liquefied natural gas flowing in the LNG flow passage 161 and the boil-off gas flowing in the BOG flow passage 162) flowing in the mixing flow passage 164 and the liquefied natural gas flowing in the LNG flow passage 165 are mixed together. The connection flow passage 166 connects a downstream end portion of the mixing flow passage 164 and a downstream end portion of the LNG flow passage 165. The liquefied natural gas having flowed in the LNG flow passage 165 flows toward the mixing flow passage 167 in the connection flow passage 166.

As illustrated in FIGS. 3 and 4, the connection flow passage 166 is formed by an additional mixing hole 14F (a second mixing hole) penetrating the base substrate 141 in the stacking direction (the upper-lower direction in FIG. 2) of the multiple flow passage substrates 14.

A liquid-added fluid mixture (a fluid mixture) generated by mixing of the fluid mixture flowing in the mixing flow passage 164 and the liquefied natural gas flowing in the LNG flow passage 165 flows in the mixing flow passage 167. The mixing flow passage 167 is connected to the downstream end portion of the mixing flow passage 164 to extend continuously from the mixing flow passage 164. The mixing flow passage 167 is formed to extend in a direction perpendicular to the stacking direction (the upper-lower direction in FIG. 2) of the multiple flow passage substrates 14, i.e., to extend along the overlapping surfaces of the flow passage substrates 14.

As illustrated in FIG. 4, the mixing flow passage 167 is defined by a flow passage groove 14G (a second mixing flow passage groove, an additional mixing flow passage groove) opening at the first overlapping surface 14S1 of the base substrate 141 and formed to extend along the first overlapping surface 14S1. Specifically, the mixing flow passage 167 is formed in such a tunnel shape that an opening (an opening formed at the first overlapping surface 14S1 of the base substrate 141) of the flow passage groove 14G is covered with the first substrate 142 in a state in which the base substrate 141 and the first substrate 142 are joined to each other. As another expression, the mixing flow passage 167 is defined between an inner surface of the flow passage groove 14G and the overlapping surface of the first substrate 142. The flow passage groove 14G is, at an upstream end thereof, connected to a downstream end of the mixing flow passage groove 14D forming the mixing flow passage 164. That is, the flow passage groove 14G is formed continuously to the mixing flow passage groove 14D. Note that it is enough to form the flow passage groove 14G at at least one of the base substrate 141 or the first substrate 142.

A partition wall 1412 is present between the LNG flow passage 165 and the mixing flow passage 167. The partition wall 1412 separates the LNG flow passage 165 and the mixing flow passage 167 from each other such that the LNG flow passage 165 and the mixing flow passage 167 are provided independently of each other. The partition wall 1412 is formed by a portion of the base substrate 141 positioned between the LNG flow passage groove 14E and the flow passage groove 14G.

Subsequently, the multiple gas cooling flow passages 18 will be described. The multiple gas cooling flow passages 18 are formed to extend in parallel with each other. The multiple gas cooling flow passages 18 are formed to overlap with the multiple fluid flow passages 16 as viewed in the stacking direction (the upper-lower direction in FIG. 2) of the multiple flow passage substrates 14.

Gas refrigerant (also referred to as gas cooling refrigerant or refrigerant) flows in the gas cooling flow passages 18. The gas refrigerant may be, for example, the liquefied natural gas stored in the storage tank 30 or liquefied nitrogen supplied from the outside and having a lower temperature than that of the boil-off gas. The gas cooling flow passages 18 are formed adjacent to the BOG flow passage 162, the mixing flow passage 164, and the mixing flow passage 167 in the stacking direction (the upper-lower direction in FIG. 2) of the multiple flow passage substrates 14 such that the boil-off gas flowing in the BOG flow passage 162, the fluid mixture flowing in the mixing flow passage 164, and the liquid-added fluid mixture flowing in the mixing flow passage 167 are cooled. The gas cooling flow passages 18 are formed to extend in a direction perpendicular to the stacking direction of the multiple flow passage substrates 14, i.e., to extend along the overlapping surfaces of the flow passage substrates 14.

As illustrated also in FIG. 5, the gas cooling flow passage 18 is defined by a cooling flow passage groove 14H (a gas cooling flow passage groove) (FIG. 2) opening at the overlapping surface 144S2 of the third substrate 144 including the second surface and formed to extend along such an overlapping surface. Specifically, the gas cooling flow passage 18 is formed in such a tunnel shape that an opening (an opening formed at the overlapping surface of the third substrate 144 including the second surface) of the cooling flow passage groove 14H is covered with the first substrate 142 in a state in which the first substrate 142 and the third substrate 144 are joined to each other. As another expression, the gas cooling flow passage 18 is defined between an inner surface of the cooling flow passage groove 14H and the overlapping surface of the first substrate 142. Note that it is enough to form the cooling flow passage groove 14H at at least one of the first substrate 142 or the third substrate 144.

A separation wall 1421 is present between the gas cooling flow passages 18 and each of the BOG flow passage 162, the mixing flow passage 164, and the mixing flow passage 167. The separation wall 1421 separates the gas cooling flow passage 18 from the BOG flow passage 162, the mixing flow passage 164, and the mixing flow passage 167 such that the gas cooling flow passage 18 and each of the BOG flow passage 162, the mixing flow passage 164, and the mixing flow passage 167 are provided independently of each other. The separation wall 1421 is formed by the first substrate 142.

Subsequently, the method for reliquefying the boil-off gas by the reliquefaction device 10 will be described. In the reliquefaction device 10, reliquefaction of the boil-off gas is promoted by direct heat exchange between the boil-off gas and the liquefied natural gas by mixing of the boil-off gas flowing in the BOG flow passage 162 and the liquefied natural gas flowing in the LNG flow passage 161. Thus, the boil-off gas can be reliquefied.

The BOG flow passage 162 described herein is adjacent to the gas cooling flow passage 18 through the separation wall 1421. Thus, evaporation of the liquefied natural gas upon mixing of the boil-off gas flowing in the BOG flow passage 162 and the liquefied natural gas flowing in the LNG flow passage 161 can be reduced by indirect heat exchange between the boil-off gas flowing in the BOG flow passage 162 and the gas refrigerant flowing in the gas cooling flow passage 18 through the separation wall 1421. As a result, reliquefaction of the boil-off gas can be efficiently performed.

Moreover, in the reliquefaction device 10, the mixing flow passage 164 is adjacent to the gas cooling flow passage 18 through the separation wall 1421. Thus, reliquefaction of the boil-off gas contained in the fluid mixture is promoted by indirect heat exchange between the fluid mixture flowing in the mixing flow passage 164 and the gas refrigerant flowing in the gas cooling flow passage 18 through the separation wall 1421. As a result, reliquefaction of the boil-off gas can be efficiently performed.

Further, in the reliquefaction device 10, reliquefaction of the boil-off gas contained in the fluid mixture is promoted by direct heat exchange between the fluid mixture and the added liquefied natural gas by mixing of the liquefied natural gas flowing in the LNG flow passage 165 with the fluid mixture flowing in the mixing flow passage 164. As a result, reliquefaction of the boil-off gas can be efficiently performed.

In addition, in the reliquefaction device 10, the mixing flow passage 167 in which the liquid-added fluid mixture generated by mixing of the fluid mixture flowing in the mixing flow passage 164 and the liquefied natural gas flowing in the LNG flow passage 165 flows is adjacent to the gas cooling flow passage 18 through the separation wall 1421. Thus, reliquefaction of the boil-off gas contained in the fluid mixture flowing in the mixing flow passage 167 is promoted by indirect heat exchange between the liquid-added fluid mixture flowing in the mixing flow passage 167 and the gas refrigerant flowing in the gas cooling flow passage 18 through the separation wall 1421. As a result, reliquefaction of the boil-off gas can be efficiently performed.

In the reliquefaction device 10, the flow passage is formed between two of the multiple flow passage substrates 14 overlapping with each other in the stacking direction, and therefore, the number of substrates necessary for forming the flow passages can be reduced.

Moreover, in the reliquefaction device 10, the grooves and the holes necessary for forming the multiple fluid flow passages 16 are formed only at the base substrate 141, and therefore, processing necessary for forming these grooves and holes is intensively performed for the base substrate 141.

Further, in the reliquefaction device 10, no grooves for forming the flow passages are formed at the first substrate 142, and therefore, the thickness of the first substrate 142 itself can be decreased. As a result, indirect heat exchange between the boil-off gas flowing in the BOG flow passage 162 and the gas refrigerant flowing in the gas cooling flow passage 18 through the separation wall 1421 can be efficiently performed.

Second Embodiment

Figure 6:
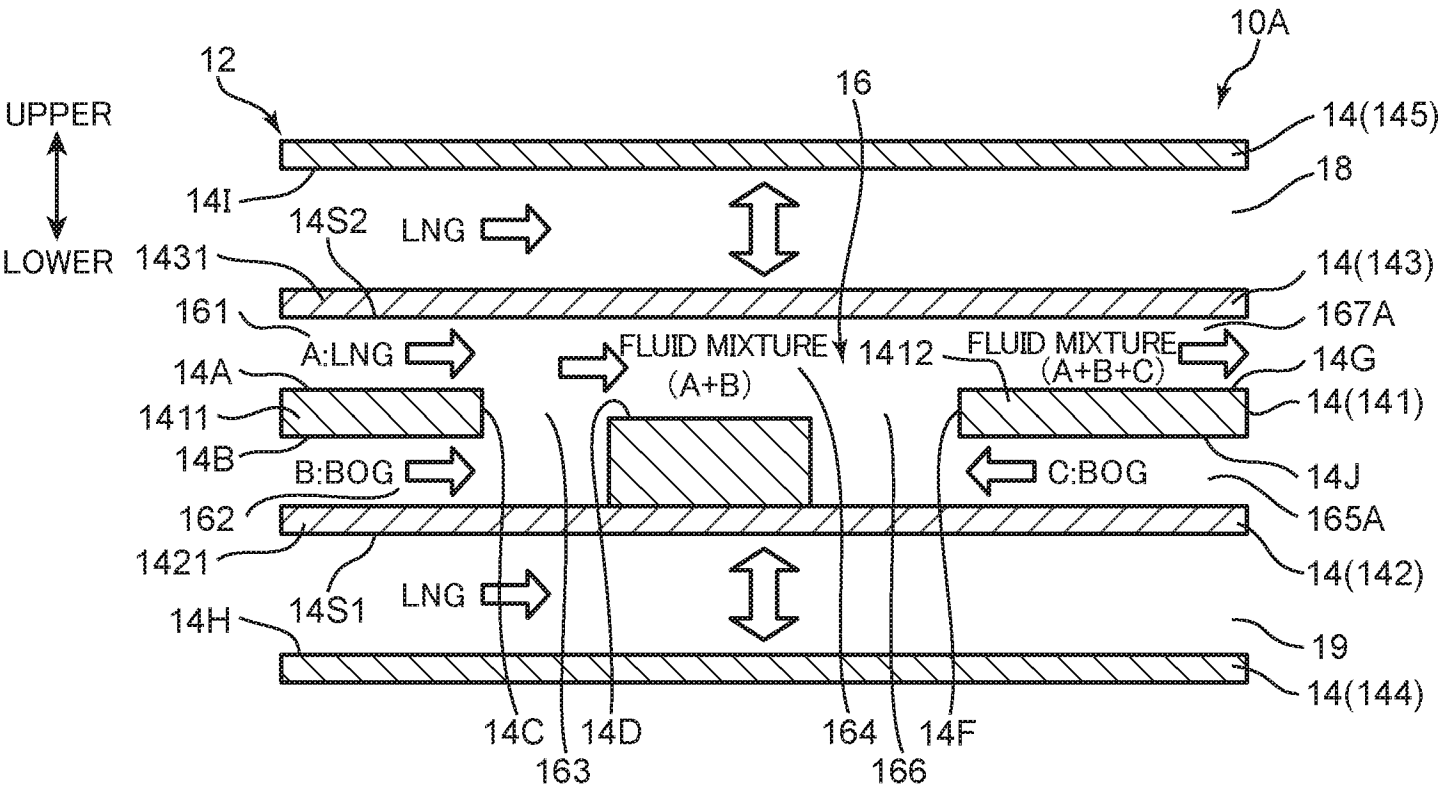
FIG. 6 is a sectional view illustrating an outline configuration of a reliquefaction device according to a second embodiment of the present invention.

Subsequently, a reliquefaction device 10A according to a second embodiment of the present invention will be described with reference to FIG. 6. FIG. 6 is a sectional view illustrating an outline configuration of the reliquefaction device 10A. Note that in FIG. 6, one side in a stacking direction (an upper-lower direction in FIG. 6) in which multiple flow passage substrates 14 are stacked on each other corresponds to a lower side in FIG. 6 and the other side corresponds to an upper side in FIG. 6.

In the reliquefaction device 10A, a mixing flow passage 164 is, as compared to the reliquefaction device 10, formed to extend continuously from an LNG flow passage 161 and is connected to a downstream end portion of the LNG flow passage 161. Boil-off gas flowing in a BOG flow passage 162 (a first gas flow passage) flows toward the LNG flow passage 161 (a first liquid flow passage) in a connection flow passage 163 (a first connection flow passage).

As compared to the reliquefaction device 10, the reliquefaction device 10A has a BOG flow passage 165A (a second gas flow passage, an additional gas flow passage) instead of an LNG flow passage 165. As in the LNG flow passage 165, the BOG flow passage 165A is formed between a base substrate 141 and a first substrate 142. That is, the BOG flow passage 165A is formed at the same position as that of the BOG flow passage 162 in the stacking direction (the upper-lower direction in FIG. 6) of the multiple flow passage substrates 14. The boil-off gas flowing in the BOG flow passage 165A flows toward the mixing flow passage 164 (a first mixing flow passage) in a connection flow passage 166 (a second connection flow passage).

In the reliquefaction device 10A, a gas cooling flow passage 19 (a first cooling flow passage) is, as compared to the reliquefaction device 10, formed adjacent to the BOG flow passage 162 and the BOG flow passage 165A in the stacking direction (the upper-lower direction in FIG. 6) of the multiple flow passage substrates 14 through a separation wall 1421 such that the boil-off gas flowing in the BOG flow passage 162 and the boil-off gas flowing in the BOG flow passage 165A are cooled. Moreover, a fluid cooling flow passage 18 (a second cooling flow passage) is formed adjacent to the LNG flow passage 161, the mixing flow passage 164, and a mixing flow passage 167A in the stacking direction (the upper-lower direction in FIG. 6) of the multiple flow passage substrates 14 through an isolation wall 1431 such that LNG gas flowing in the LNG flow passage 161 and a fluid mixture flowing in the mixing flow passage 164 and the mixing flow passage 167A (a third mixing flow passage, a gas-added mixing flow passage) are cooled.

The reliquefaction device 10A has the mixing flow passage 167A instead of the mixing flow passage 167 of the reliquefaction device 10. As in the mixing flow passage 167, the mixing flow passage 167A is formed between the base substrate 141 and a second substrate 143. The mixing flow passage 167A is formed at the same position as that of the LNG flow passage 161 in the stacking direction (the upper-lower direction in FIG. 6) of the multiple flow passage substrates 14. The fluid flowing in the mixing flow passage 167A is a gas-added fluid mixture (a fluid mixture) formed by mixing of the boil-off gas (an additional reliquefaction target gas, second target gas) flowing in the BOG flow passage 165A with the fluid mixture (the fluid formed by mixing of the liquefied natural gas flowing in the LNG flow passage 161 and the boil-off gas flowing in the BOG flow passage 162).

As compared to the reliquefaction device 10, in the reliquefaction device 10A, the multiple flow passage substrates 14 further include a fourth substrate 145 (a fluid cooling flow passage substrate). As in the base substrate 141, the fourth substrate 145 has a rectangular plate shape as a whole. As in the base substrate 141, the fourth substrate 145 has a first surface positioned on one side (the lower side in FIG. 6) and a second surface positioned on the other side (the upper side in FIG. 6) in the stacking direction (the upper-lower direction in FIG. 6) in which the multiple flow passage substrates 14 are stacked on each other. The fourth substrate 145 and the base substrate 141 have the same shape as viewed in plane. The fourth substrate 145 is joined to the second substrate 143 in a state in which an overlapping surface of the fourth substrate 145 including the first surface overlaps with an overlapping surface of the second substrate 143 including a second surface.

In the reliquefaction device 10A, a flow passage unit 12 further includes multiple fluid cooling flow passages 18. The multiple fluid cooling flow passages 18 are formed to extend in parallel with each other.

Fluid cooling refrigerant flows in the fluid cooling flow passage 18. The fluid cooling refrigerant may be, for example, the liquefied natural gas stored in a storage tank 30 or liquefied nitrogen supplied from the outside. The fluid cooling flow passage 18 is formed adjacent to the mixing flow passage 164 and the mixing flow passage 167A in the stacking direction (the upper-lower direction in FIG. 6) of the multiple flow passage substrates 14 such that the fluid mixture (the mixed fluid of the liquefied natural gas flowing in the LNG flow passage 161 and the boil-off gas flowing in the BOG flow passage 162) flowing in the mixing flow passage 164 and the gas-added fluid mixture (the mixed fluid of the liquefied natural gas flowing in the LNG flow passage 161, the boil-off gas flowing in the BOG flow passage 162, and the boil-off gas flowing in the BOG flow passage 165A) flowing in the mixing flow passage 167A are cooled. The fluid cooling flow passage 18 is formed to extend in a direction perpendicular to the stacking direction of the multiple flow passage substrates 14, i.e., to extend along overlapping surfaces of the flow passage substrates 14.

The fluid cooling flow passage 18 is defined by a flow passage groove 14I (a fluid cooling flow passage groove) opening at the overlapping surface of the fourth substrate 145 including the second surface and formed to extend along such an overlapping surface. Specifically, the fluid cooling flow passage 18 is formed in such a tunnel shape that an opening (an opening formed at the overlapping surface of the fourth substrate 145 including the second surface) of the flow passage groove 14I is covered with the second substrate 143 in a state in which the second substrate 143 and the fourth substrate 145 are joined to each other. As another expression, the fluid cooling flow passage 18 is defined between an inner surface of the flow passage groove 14I and the overlapping surface of the second substrate 143. Note that it is enough to form the flow passage groove 14I at at least one of the second substrate 143 or the fourth substrate 145.

The isolation wall 1431 is present between the fluid cooling flow passage 18 and each of the mixing flow passage 164 and the mixing flow passage 167A. The isolation wall 1431 separates the fluid cooling flow passage 18 from the mixing flow passage 164 and the mixing flow passage 167A such that the fluid cooling flow passage 18 and each of the mixing flow passage 164 and the mixing flow passage 167A are provided independently of each other. The isolation wall 1431 is formed by the second substrate 143.

Note that multiple grooves provided at the base substrate 141 include a BOG flow passage groove 14J (a second gas flow passage groove, an additional gas flow passage groove) and a flow passage groove 14G. The BOG flow passage groove 14J is provided at the above-described first overlapping surface, and forms the BOG flow passage 165A. The flow passage groove 14G is provided continuously to the mixing flow passage groove 14D at the above-described second overlapping surface, and forms the mixing flow passage 167A. The connection flow passage 166 is provided to penetrate the base substrate 141 in the stacking direction, and is formed by an additional mixing hole 14F connecting the mixing flow passage groove 14D and the BOG flow passage groove 14J to each other. Moreover, a partition wall 1412 present between the BOG flow passage 165A and the mixing flow passage 167A in the stacking direction is formed by a portion of the base substrate 141 positioned between the BOG flow passage groove 14J and the flow passage groove 14G in the stacking direction. The isolation wall 1431 present between the mixing flow passage 167A and the fluid cooling flow passage 18 in the stacking direction is formed by a portion of the second substrate 143 adjacent to the flow passage groove 14G in the stacking direction.

Moreover, the mixing flow passage 167A is adjacent to the fluid cooling flow passage 18 through the isolation wall 1431 present between the mixing flow passage 167A and the fluid cooling flow passage 18 in the stacking direction. Thus, the mixing flow passage 167A is provided independently of the fluid cooling flow passage 18, and is connected to a downstream end portion of the mixing flow passage 164 to extend continuously from the mixing flow passage 164. Further, the fluid cooling flow passage 18 allows such a refrigerant flow that reliquefaction of the additional reliquefaction target gas contained in the gas-added fluid mixture flowing in the mixing flow passage 167A is promoted by cooling of the gas-added fluid mixture flowing in the mixing flow passage 167A by indirect heat exchange between the gas-added fluid mixture flowing in the mixing flow passage 167A and the refrigerant (the fluid cooling refrigerant) through the isolation wall 1431.

Subsequently, the method for reliquefying the boil-off gas by the reliquefaction device 10A will be described. In the reliquefaction device 10A, reliquefaction of the boil-off gas is promoted by direct heat exchange between the boil-off gas and the liquefied natural gas by mixing of the boil-off gas flowing in the BOG flow passage 162 and the liquefied natural gas flowing in the LNG flow passage 161. As a result, the boil-off gas can be reliquefied.

The BOG flow passage 162 described herein is adjacent to the gas cooling flow passage 19 through the separation wall 1421. Thus, evaporation of the liquefied natural gas upon mixing of the boil-off gas flowing in the BOG flow passage 162 and the liquefied natural gas flowing in the LNG flow passage 161 can be reduced by indirect heat exchange between the boil-off gas flowing in the BOG flow passage 162 and the refrigerant flowing in the gas cooling flow passage 19 through the separation wall 1421. As a result, reliquefaction of the boil-off gas can be efficiently performed.

Moreover, in the reliquefaction device 10A, the mixing flow passage 164 is adjacent to the fluid cooling flow passage 18 through the isolation wall 1431. Thus, reliquefaction of the boil-off gas contained in the fluid mixture is promoted by indirect heat exchange between the fluid mixture flowing in the mixing flow passage 164 and the refrigerant flowing in the fluid cooling flow passage 18 through the isolation wall 1431. As a result, reliquefaction of the boil-off gas can be efficiently performed.

Further, in the reliquefaction device 10A, reliquefaction of the boil-off gas added to the fluid mixture is promoted by direct heat exchange between the liquefied natural gas (the liquefied natural gas contained in the fluid mixture) and the additional boil-off gas by mixing of the additional boil-off gas flowing in the BOG flow passage 165A to the fluid mixture flowing in the mixing flow passage 164. As a result, reliquefaction of the additional boil-off gas can be efficiently performed.

In addition, in the reliquefaction device 10A, the mixing flow passage 167A in which the gas-added fluid mixture generated by mixing of the fluid mixture flowing in the mixing flow passage 164 and the boil-off gas flowing in the BOG flow passage 165A flows is adjacent to the fluid cooling flow passage 18 through the isolation wall 1431. Thus, reliquefaction of the additional boil-off gas contained in the gas-added fluid mixture flowing in the mixing flow passage 167A is promoted by indirect heat exchange between the gas-added fluid mixture flowing in the mixing flow passage 167A and the refrigerant flowing in the fluid cooling flow passage 18 through the isolation wall 1431. As a result, reliquefaction of the additional boil-off gas can be efficiently performed.

In the reliquefaction device 10A, advantageous effects similar to those of the reliquefaction device 10 can be obtained.

Moreover, in the reliquefaction device 10A, no grooves for forming the flow passages are formed at the second substrate 143, and therefore, the thickness of the second substrate 143 itself can be decreased. As a result, indirect heat exchange between each of the fluid mixture flowing in the mixing flow passage 164 and the gas-added fluid mixture flowing in the mixing flow passage 167A and the refrigerant flowing in the fluid cooling flow passage 18 through the isolation wall 1431 can be efficiently performed.

Further, in the reliquefaction device 10A, gas targeted for reliquefaction is separated into the boil-off gas as reliquefaction target gas and the additional boil-off gas as the additional reliquefaction target gas, and thereafter, is sequentially mixed with the liquefied natural gas as reliquefaction promoting liquid. Thus, as compared to a case where the boil-off gas and the additional boil-off gas are mixed with the liquefied natural gas at a time, the amount of each of the boil-off gas and the additional boil-off gas to be mixed with the liquefied natural gas can be reduced. Thus, evaporation of the liquefied natural gas upon mixing of each of the boil-off gas and the additional boil-off gas with the liquefied natural gas can be reduced. As a result, reliquefaction of the boil-off gas and the additional boil-off gas can be efficiently performed.

The embodiments of the present invention have been described above in detail, but are merely examples. The present invention is not interpreted in a limited manner by description of the embodiments above.

For example, the formation position of the flow passage groove, the direction of extension of the flow passage groove, and the length of the flow passage groove at each flow passage substrate are not limited to those described in the embodiments above.

Provided is, according to the present invention, a reliquefaction device for reliquefying first target gas, which is gas evaporated from liquid and a reliquefaction target, by direct heat exchange between the first target gas and first promoting liquid, which is the liquid to be mixed with the first target gas and which promotes reliquefaction of the first target gas, by mixing the first target gas and the first promoting liquid. The reliquefaction device includes a flow passage unit configured such that multiple flow passages allowing the flow of fluid containing at least one of the first target gas or the first promoting liquid are formed. The flow passage unit includes multiple flow passage substrates joined to each other in a state in which the flow passage substrates are stacked on each other in a predetermined direction, and at at least one of overlapping surfaces of two of the multiple flow passage substrates overlapping with each other in a stacking direction, multiple grooves extending along the overlapping surfaces and forming at least part of the multiple flow passages are provided. The multiple flow passages include a first liquid flow passage formed to extend along the overlapping surfaces and allowing the flow of the first promoting liquid, a first gas flow passage provided adjacent to the first liquid flow passage through a partition wall present between the first gas flow passage and the first liquid flow passage in the stacking direction, provided independently of the first liquid flow passage, formed to extend along the overlapping surfaces, and allowing the flow of the first target gas, a first connection flow passage formed to extend in the stacking direction and connecting the first liquid flow passage and the first gas flow passage to each other, a first mixing flow passage connected to a downstream end portion of any of the first liquid flow passage and the first gas flow passage, formed to extend along the overlapping surfaces, and allowing flow of a fluid mixture containing the first target gas and the first promoting liquid, and a first cooling flow passage provided adjacent to the first gas flow passage through a separation wall present between the first cooling flow passage and the first gas flow passage in the stacking direction, provided independently of the first gas flow passage, and allowing the flow of refrigerant such that indirect heat exchange between the first target gas and the refrigerant is performed through the separation wall.

In the above-described reliquefaction device, the fluid mixture is generated by mixing of the first promoting liquid flowing in the first liquid flow passage and the first target gas flowing in the first gas flow passage, and therefore, reliquefaction of the first target gas is promoted by direct heat exchange between the first promoting liquid and the first target gas. Thus, the first target gas can be reliquefied.

In the above-described reliquefaction device, the first target gas flowing in the first gas flow passage is cooled in advance, and thereafter, is mixed with the first promoting liquid flowing in the first liquid flow passage. Thus, evaporation of the first promoting liquid upon mixing of the first target gas flowing in the first gas flow passage and the first promoting liquid flowing in the first liquid flow passage can be reduced. As a result, the first target gas can be efficiently reliquefied.

In addition, in the above-described reliquefaction device, precooling of the first target gas flowing in the first gas flow passage is performed by indirect heat exchange between the refrigerant flowing in the first cooling flow passage and the first target gas through the separation wall. Thus, precooling of the first target gas flowing in the first gas flow passage can be performed without the need for mixing the refrigerant with the first target gas.

In the above-described configuration, the multiple flow passage substrates preferably include a base substrate having a first overlapping surface as the overlapping surface positioned on one side in the stacking direction and a second overlapping surface as the overlapping surface positioned on the other side in the stacking direction, a first substrate joined to the base substrate in a state in which the first substrate overlaps with the first overlapping surface and forming the first gas flow passage between the first substrate and the base substrate, a second substrate joined to the base substrate in a state in which the second substrate overlaps with the second overlapping surface and forming the first liquid flow passage between the second substrate and the base substrate, and a third substrate joined to the first substrate in a state in which the third substrate overlaps with the overlapping surface of the first substrate positioned on one side in the stacking direction and forming the first cooling flow passage between the third substrate and the first substrate.

According to the present configuration, the flow passage is formed between two flow passage substrates overlapping with each other in the stacking direction, and therefore, the number of flow passage substrates necessary for forming the flow passages can be reduced.

In the above-described configuration, the multiple grooves provided at the base substrate preferably include a first gas flow passage groove provided at the first overlapping surface and forming the first gas flow passage, and a first liquid flow passage groove provided at the second overlapping surface and forming the first liquid flow passage. The first connection flow passage is preferably provided to penetrate the base substrate in the stacking direction, and is preferably formed by a first mixing hole connecting the first gas flow passage groove and the first liquid flow passage groove to each other. The partition wall present between the first gas flow passage and the first liquid flow passage in the stacking direction is preferably formed by a portion of the base substrate positioned between the first gas flow passage groove and the first liquid flow passage groove in the stacking direction.

According to the present configuration, the first gas flow passage groove provided at the first overlapping surface of the base substrate and the first liquid flow passage groove provided at the second overlapping surface can be communicated with each other only by formation of the first mixing hole at the base substrate. As a result, processing necessary for forming the first gas flow passage, the first liquid flow passage, and the first connection flow passage is intensively performed for the base substrate.

In the above-described configuration, the multiple grooves provided at the third substrate preferably include a cooling flow passage groove provided at the overlapping surface of the third substrate positioned on the other side in the stacking direction and forming the first cooling flow passage. The separation wall present between the first gas flow passage and the first cooling flow passage in the stacking direction is preferably formed by a portion of the first substrate adjacent to the first gas flow passage groove in the stacking direction.

According to the present configuration, the necessity of forming a groove for forming a flow passage at the first substrate is reduced, and therefore, the thickness of the first substrate itself can be decreased. As a result, indirect heat exchange between the first target gas flowing in the first gas flow passage and the refrigerant flowing in the first cooling flow passage through the separation wall can be efficiently performed.

In the above-described configuration, the first mixing flow passage is preferably adjacent to the first cooling flow passage through a separation wall present between the first mixing flow passage and the first cooling flow passage in the stacking direction, is provided independently of the first cooling flow passage, and is connected to a downstream end portion of the first gas flow passage to extend continuously from the first gas flow passage. The first cooling flow passage preferably allows the flow of the refrigerant such that reliquefaction of the first target gas contained in the fluid mixture flowing in the first mixing flow passage is promoted by cooling of the fluid mixture flowing in the first mixing flow passage by indirect heat exchange between the fluid mixture flowing in the first mixing flow passage and the refrigerant through the separation wall.

According to the present configuration, the fluid mixture flowing in the first mixing flow passage is cooled by indirect heat exchange between the fluid mixture flowing in the first mixing flow passage and the refrigerant flowing in the first cooling flow passage through the separation wall, and therefore, reliquefaction of the first target gas contained in the fluid mixture flowing in the first mixing flow passage is promoted. As a result, reliquefaction of the first target gas can be efficiently performed.

In the above-described configuration, the multiple grooves provided at the base substrate may further include a first mixing flow passage groove provided continuously to the first gas flow passage groove at the first overlapping surface and forming the first mixing flow passage. The separation wall present between the first mixing flow passage and the first cooling flow passage in the stacking direction may be formed by a portion of the first substrate adjacent to the first mixing flow passage groove in the stacking direction.

According to the present configuration, the first mixing flow passage groove forming the first mixing flow passage is formed at the first overlapping surface of the base substrate, and therefore, processing necessary for forming the first gas flow passage, the first liquid flow passage, the first connection flow passage, and the first mixing flow passage is intensively performed for the base substrate.

In the above-described configuration, the multiple flow passages preferably further include a second liquid flow passage formed to extend along the overlapping surfaces and allowing the flow of second promoting liquid which is the liquid to be added to the fluid mixture flowing in the first mixing flow passage and which promotes reliquefaction of the first target gas by direct heat exchange between the second promoting liquid and the first target gas contained in the fluid mixture, a second connection flow passage formed to extend in the stacking direction and connecting the first mixing flow passage and the second liquid flow passage to each other, and a second mixing flow passage provided adjacent to the second liquid flow passage through a partition wall present between the second mixing flow passage and the second liquid flow passage in the stacking direction, provided independently of the second liquid flow passage, connected to a downstream end portion of the first mixing flow passage, formed to extend along the overlapping surfaces, and allowing the flow of a fluid mixture formed by addition of the second promoting liquid to the fluid mixture.

According to the present configuration, the second promoting liquid flowing in the second liquid flow passage is further mixed with the fluid mixture flowing in the first mixing flow passage, and therefore, reliquefaction of the first target gas contained in the fluid mixture can be promoted by direct heat exchange between the first target gas contained in the fluid mixture and the second promoting liquid mixed with the fluid mixture. As a result, reliquefaction of the first target gas can be efficiently performed.

In the above-described configuration, the multiple grooves provided at the base substrate preferably include a second liquid flow passage groove provided at the second overlapping surface and forming the second liquid flow passage, and a second mixing flow passage groove provided continuously to the first mixing flow passage groove at the first overlapping surface and forming the second mixing flow passage. The second connection flow passage is preferably provided to penetrate the base substrate in the stacking direction, and is preferably formed by a second mixing hole connecting the first mixing flow passage groove and the second liquid flow passage groove to each other. The partition wall present between the second liquid flow passage and the second mixing flow passage in the stacking direction is preferably formed by a portion of the base substrate positioned between the second liquid flow passage groove and the second mixing flow passage groove in the stacking direction. A separation wall present between the second mixing flow passage and the first cooling flow passage in the stacking direction is preferably formed by a portion of the first substrate adjacent to the second mixing flow passage groove in the stacking direction.

According to the present configuration, the second liquid flow passage groove forming the second liquid flow passage is provided at the second overlapping surface of the base substrate, and the second mixing flow passage groove forming the second mixing flow passage is provided at the first overlapping surface of the base substrate. Thus, processing necessary for forming the first gas flow passage, the first liquid flow passage, the first connection flow passage, the first mixing flow passage, the second liquid flow passage, the second connection flow passage, and the second mixing flow passage is intensively performed for the base substrate.

In the above-described configuration, the second mixing flow passage is preferably adjacent to the first cooling flow passage through the separation wall present between the second mixing flow passage and the first cooling flow passage in the stacking direction, is preferably provided independently of the first cooling flow passage, and is preferably connected to the downstream end portion of the first mixing flow passage to extend continuously from the first mixing flow passage. The first cooling flow passage preferably allows the flow of the refrigerant such that reliquefaction of the first target gas contained in the fluid mixture flowing in the second mixing flow passage is promoted by cooling of the fluid mixture flowing in the second mixing flow passage by indirect heat exchange between the fluid mixture flowing in the second mixing flow passage and the refrigerant through the separation wall.

According to the present configuration, the fluid mixture flowing in the second mixing flow passage is cooled by indirect heat exchange between the fluid mixture flowing in the second mixing flow passage and the refrigerant flowing in the first cooling flow passage through the separation wall, and therefore, reliquefaction of the first target gas contained in the fluid mixture flowing in the second mixing flow passage is promoted. As a result, reliquefaction of the first target gas can be efficiently performed.

In the above-described configuration, the first mixing flow passage is preferably connected to a downstream end portion of the first liquid flow passage to extend continuously from the first liquid flow passage. The multiple flow passages preferably further include a second cooling flow passage provided adjacent to the first mixing flow passage through an isolation wall present between the second cooling flow passage and the first mixing flow passage in the stacking direction, provided independently of the first mixing flow passage, and allowing the flow of the fluid cooling refrigerant such that reliquefaction of the first target gas contained in the fluid mixture flowing in the first mixing flow passage is promoted by cooling of the fluid mixture flowing in the first mixing flow passage by indirect heat exchange with the fluid mixture flowing in the first mixing flow passage through the isolation wall.

According to the present configuration, the fluid mixture flowing in the first mixing flow passage is cooled by indirect heat exchange between the fluid mixture flowing in the first mixing flow passage and the fluid cooling refrigerant flowing in the second cooling flow passage through the separation wall, and therefore, reliquefaction of the first target gas contained in the fluid mixture flowing in the first mixing flow passage is promoted. As a result, reliquefaction of the first target gas can be efficiently performed.

In the above-described configuration, the multiple grooves provided at the base substrate preferably include a first gas flow passage groove provided at the first overlapping surface and forming the first gas flow passage, a first liquid flow passage groove provided at the second overlapping surface and forming the first liquid flow passage, and a first mixing flow passage groove provided continuously to the first liquid flow passage groove at the second overlapping surface and forming the first mixing flow passage. The isolation wall present between the first mixing flow passage and the second cooling flow passage in the stacking direction is preferably formed by a portion of the second substrate adjacent to the first mixing flow passage groove in the stacking direction.

According to the present configuration, the first mixing flow passage groove forming the first mixing flow passage is formed at the second overlapping surface of the base substrate, and therefore, the processing necessary for forming the first gas flow passage, the first liquid flow passage, the first connection flow passage, and the first mixing flow passage is intensively performed for the base substrate.

In the above-described configuration, the multiple flow passages preferably further include a second gas flow passage provided adjacent to the first cooling flow passage through a separation wall present between the second gas flow passage and the first cooling flow passage in the stacking direction, provided independently of the first cooling flow passage, formed to extend along the overlapping surfaces, and allowing the flow of second target gas which is the gas to be added to the fluid mixture flowing in the first mixing flow passage and which is targeted for reliquefaction by direct heat exchange with the first promoting liquid contained in the fluid mixture, a second connection flow passage formed to extend in the stacking direction and connecting the first mixing flow passage and the second gas flow passage to each other, and a third mixing flow passage provided adjacent to the second gas flow passage through a partition wall present between the third mixing flow passage and the second gas flow passage in the stacking direction, provided independently of the second gas flow passage, connected to a downstream end portion of the first mixing flow passage, formed to extend along the overlapping surfaces, and allowing the flow of a fluid mixture formed by addition of the second target gas to the fluid mixture.

According to the present configuration, the second target gas flowing in the second gas flow passage is further mixed with the fluid mixture flowing in the first mixing flow passage, and therefore, reliquefaction of the second target gas mixed with the fluid mixture can be promoted by direct heat exchange between the first promoting liquid contained in the fluid mixture and the second target gas mixed with the fluid mixture. As a result, reliquefaction of the second target gas can be efficiently performed.

Moreover, according to the present configuration, the gas targeted for reliquefaction is separated into the first target gas and the second target gas, and thereafter, is sequentially mixed with the first promoting liquid. Thus, as compared to a case where the first target gas and the second target gas are mixed with the first promoting liquid at a time, the amount of each of the first target gas and the second target gas to be mixed with the first promoting liquid can be reduced. Thus, evaporation of the first promoting liquid upon mixing of each of the first target gas and the second target gas with the first promoting liquid can be reduced. As a result, reliquefaction of the first target gas and the second target gas can be efficiently performed.

In the above-described configuration, the multiple grooves provided at the base substrate preferably include a second gas flow passage groove provided at the first overlapping surface and forming the second gas flow passage, and a second mixing flow passage groove provided continuously to the first mixing flow passage groove at the second overlapping surface and forming the third mixing flow passage. The second connection flow passage is preferably provided to penetrate the base substrate in the stacking direction, and is preferably formed by a second mixing hole connecting the first mixing flow passage groove and the second gas flow passage groove to each other. The partition wall present between the second gas flow passage and the third mixing flow passage in the stacking direction is preferably formed by a portion of the base substrate positioned between the second gas flow passage groove and the second mixing flow passage groove in the stacking direction. An isolation wall present between the third mixing flow passage and the second cooling flow passage in the stacking direction is preferably formed by a portion of the second substrate adjacent to the second mixing flow passage groove in the stacking direction.

According to the present configuration, the second gas flow passage groove forming the second gas flow passage is provided at the first overlapping surface of the base substrate, and the second mixing flow passage groove forming the third mixing flow passage is provided at the second overlapping surface of the base substrate. Thus, processing necessary for forming the first gas flow passage, the first liquid flow passage, the first connection flow passage, the first mixing flow passage, the second gas flow passage, the second connection flow passage, and the third mixing flow passage is intensively performed for the base substrate.

In the above-described configuration, the third mixing flow passage is preferably adjacent to the second cooling flow passage through the isolation wall present between the third mixing flow passage and the second cooling flow passage in the stacking direction, is preferably provided independently of the second cooling flow passage, and is preferably connected to the downstream end portion of the first mixing flow passage to extend continuously from the first mixing flow passage. The second cooling flow passage preferably allows the flow of the fluid cooling refrigerant such that reliquefaction of the second target gas contained in the fluid mixture flowing in the third mixing flow passage is promoted by cooling of the fluid mixture flowing in the third mixing flow passage by indirect heat exchange between the fluid mixture flowing in the third mixing flow passage and the fluid cooling refrigerant through the isolation wall.

According to the present configuration, the fluid mixture flowing in the third mixing flow passage is cooled by indirect heat exchange between the fluid mixture flowing in the third mixing flow passage and the fluid cooling refrigerant flowing in the second cooling flow passage through the separation wall, and therefore, reliquefaction of the second target gas contained in the fluid mixture flowing in the third mixing flow passage is promoted. As a result, reliquefaction of the second target gas can be efficiently performed.

The invention claimed is:

1. A reliquefaction device comprising:

a storage tank configured to store a first target gas and a first promoting liquid from which the first target gas evaporates;

a circulation flow passage having a first end connected to the storage tank at a first position that allows for the first target gas and not the first promoting liquid to flow through the circulation flow passage, the circulation flow passage having a second end downstream of the first end connected to a first gas flow passage and configured to supply the first target gas to the first gas flow passage;

a supply flow passage having a first end connected to the storage tank at a second position different than the first position that allows for the first promoting liquid and not the first target gas to flow through the supply flow passage, the supply flow passage having a second end downstream of the first end connected to a first liquid flow passage and configured to supply the first promoting liquid to the first liquid flow passage;

a flow passage unit configured such that multiple flow passages allowing a flow of fluid containing at least one of the first target gas or the first promoting liquid are formed, wherein the flow passage unit includes multiple flow passage substrates joined to each other in a state in which the flow passage substrates are stacked on each other in a predetermined direction, and at at least one of overlapping surfaces of two of the multiple flow passage substrates overlapping with each other in a stacking direction, multiple grooves extending along the overlapping surfaces and forming at least part of the multiple flow passages are provided, the multiple flow passages include the first liquid flow passage formed to extend along the overlapping surfaces and allowing a flow of the first promoting liquid, the first gas flow passage provided adjacent to the first liquid flow passage through a partition wall present between the first gas flow passage and the first liquid flow passage in the stacking direction, provided independently of the first liquid flow passage, formed to extend along the overlapping surfaces, and allowing a flow of the first target gas, a first connection flow passage formed to extend in the stacking direction and connecting the first liquid flow passage and the first gas flow passage to each other, a first mixing flow passage connected to a downstream end portion of any of the first liquid flow passage and the first gas flow passage, formed to extend along the overlapping surfaces, and allowing the flow of a fluid mixture containing the first target gas and the first promoting liquid, and a first cooling flow passage provided adjacent to the first gas flow passage through a separation wall present between the first cooling flow passage and the first gas flow passage in the stacking direction, provided independently of the first gas flow passage, and allowing a flow of refrigerant such that indirect heat exchange between the first target gas and the refrigerant is performed through the separation wall, and wherein the refrigerant is supplied to the first cooling flow passage from a source other than the storage tank.

2. The reliquefaction device according to claim 1, wherein the multiple flow passage substrates include a base substrate having a first overlapping surface as the overlapping surface positioned on one side in the stacking direction and a second overlapping surface as the overlapping surface positioned on the other side in the stacking direction, a first substrate joined to the base substrate in a state in which the first substrate overlaps with the first overlapping surface and forming the first gas flow passage between the first substrate and the base substrate, a second substrate joined to the base substrate in a state in which the second substrate overlaps with the second overlapping surface and forming the first liquid flow passage between the second substrate and the base substrate, and a third substrate joined to the first substrate in a state in which the third substrate overlaps with the overlapping surface of the first substrate positioned on one side in the stacking direction and forming the first cooling flow passage between the third substrate and the first substrate.

3. The reliquefaction device according to claim 2, wherein the multiple grooves provided at the base substrate include a first gas flow passage groove provided at the first overlapping surface and forming the first gas flow passage, and a first liquid flow passage groove provided at the second overlapping surface and forming the first liquid flow passage, the first connection flow passage is provided to penetrate the base substrate in the stacking direction, and is formed by a first mixing hole connecting the first gas flow passage groove and the first liquid flow passage groove to each other, and the partition wall present between the first gas flow passage and the first liquid flow passage in the stacking direction is formed by a portion of the base substrate positioned between the first gas flow passage groove and the first liquid flow passage groove in the stacking direction.

4. The reliquefaction device according to claim 3, wherein the multiple grooves provided at the third substrate include a cooling flow passage groove provided at the overlapping surface of the third substrate positioned on the other side in the stacking direction and forming the first cooling flow passage, and the separation wall present between the first gas flow passage and the first cooling flow passage in the stacking direction is formed by a portion of the first substrate adjacent to the first gas flow passage groove in the stacking direction.

5. The reliquefaction device according to claim 1, wherein the first mixing flow passage is adjacent to the first cooling flow passage through a separation wall present between the first mixing flow passage and the first cooling flow passage in the stacking direction, is provided independently of the first cooling flow passage, and is connected to a downstream end portion of the first gas flow passage to extend continuously from the first gas flow passage, and the first cooling flow passage allows the flow of the refrigerant such that reliquefaction of the first target gas contained in the fluid mixture flowing in the first mixing flow passage is promoted by cooling of the fluid mixture flowing in the first mixing flow passage by indirect heat exchange between the fluid mixture flowing in the first mixing flow passage and the refrigerant through the separation wall.

6. The reliquefaction device according to claim 3, wherein the multiple grooves provided at the base substrate further include a first mixing flow passage groove provided continuously to the first gas flow passage groove at the first overlapping surface and forming the first mixing flow passage, and the separation wall present between the first mixing flow passage and the first cooling flow passage in the stacking direction is formed by a portion of the first substrate adjacent to the first mixing flow passage groove in the stacking direction.

7. The reliquefaction device according to claim 6, wherein the multiple flow passages further include a second liquid flow passage formed to extend along the overlapping surfaces and allowing a flow of second promoting liquid which is the liquid to be added to the fluid mixture flowing in the first mixing flow passage and which promotes reliquefaction of the first target gas by direct heat exchange between the second promoting liquid and the first target gas contained in the fluid mixture, a second connection flow passage formed to extend in the stacking direction and connecting the first mixing flow passage and the second liquid flow passage to each other, and a second mixing flow passage provided adjacent to the second liquid flow passage through a partition wall present between the second mixing flow passage and the second liquid flow passage in the stacking direction, provided independently of the second liquid flow passage, connected to a downstream end portion of the first mixing flow passage, formed to extend along the overlapping surfaces, and allowing a flow of a fluid mixture formed by addition of the second promoting liquid to the fluid mixture.

8. The reliquefaction device according to claim 7, wherein the multiple grooves provided at the base substrate include a second liquid flow passage groove provided at the second overlapping surface and forming the second liquid flow passage, and a second mixing flow passage groove provided continuously to the first mixing flow passage groove at the first overlapping surface and forming the second mixing flow passage, the second connection flow passage is provided to penetrate the base substrate in the stacking direction, and is formed by a second mixing hole connecting the first mixing flow passage groove and the second liquid flow passage groove to each other, the partition wall present between the second liquid flow passage and the second mixing flow passage in the stacking direction is formed by a portion of the base substrate positioned between the second liquid flow passage groove and the second mixing flow passage groove in the stacking direction, and a separation wall present between the second mixing flow passage and the first cooling flow passage in the stacking direction is formed by a portion of the first substrate adjacent to the second mixing flow passage groove in the stacking direction.

9. The reliquefaction device according to claim 7, wherein the second mixing flow passage is adjacent to the first cooling flow passage through the separation wall present between the second mixing flow passage and the first cooling flow passage in the stacking direction, is provided independently of the first cooling flow passage, and is connected to the downstream end portion of the first mixing flow passage to extend continuously from the first mixing flow passage, and the first cooling flow passage allows the flow of the refrigerant such that reliquefaction of the first target gas contained in the fluid mixture flowing in the second mixing flow passage is promoted by cooling of the fluid mixture flowing in the second mixing flow passage by indirect heat exchange between the fluid mixture flowing in the second mixing flow passage and the refrigerant through the separation wall.

10. The reliquefaction device according to claim 2, wherein the first mixing flow passage is connected to a downstream end portion of the first liquid flow passage to extend continuously from the first liquid flow passage, and the multiple flow passages further include a second cooling flow passage provided adjacent to the first mixing flow passage through an isolation wall present between the second cooling flow passage and the first mixing flow passage in the stacking direction, provided independently of the first mixing flow passage, and allowing the flow of the refrigerant such that reliquefaction of the first target gas contained in the fluid mixture flowing in the first mixing flow passage is promoted by cooling of the fluid mixture flowing in the first mixing flow passage by indirect heat exchange with the fluid mixture flowing in the first mixing flow passage through the isolation wall.

11. The reliquefaction device according to claim 10, wherein the multiple grooves provided at the base substrate include a first gas flow passage groove provided at the first overlapping surface and forming the first gas flow passage, a first liquid flow passage groove provided at the second overlapping surface and forming the first liquid flow passage, and a first mixing flow passage groove provided continuously to the first liquid flow passage groove at the second overlapping surface and forming the first mixing flow passage, and the isolation wall present between the first mixing flow passage and the second cooling flow passage in the stacking direction is formed by a portion of the second substrate adjacent to the first mixing flow passage groove in the stacking direction.

12. The reliquefaction device according to claim 11, wherein the multiple grooves further include a second gas flow passage provided adjacent to the first cooling flow passage through a separation wall present between the second gas flow passage and the first cooling flow passage in the stacking direction, provided independently of the first cooling flow passage, formed to extend along the overlapping surfaces, and allowing a flow of second target gas which is the gas to be added to the fluid mixture flowing in the first mixing flow passage and which is targeted for reliquefaction by direct heat exchange with the first promoting liquid contained in the fluid mixture, a second connection flow passage formed to extend in the stacking direction and connecting the first mixing flow passage and the second gas flow passage to each other, and a third mixing flow passage provided adjacent to the second gas flow passage through a partition wall present between the third mixing flow passage and the second gas flow passage in the stacking direction, provided independently of the second gas flow passage, connected to a downstream end portion of the first mixing flow passage, formed to extend along the overlapping surfaces, and allowing a flow of a fluid mixture formed by addition of the second target gas to the fluid mixture.

13. The reliquefaction device according to claim 12, wherein the multiple grooves provided at the base substrate include a second gas flow passage groove provided at the first overlapping surface and forming the second gas flow passage, and a second mixing flow passage groove provided continuously to the first mixing flow passage groove at the second overlapping surface and forming the third mixing flow passage, the second connection flow passage is provided to penetrate the base substrate in the stacking direction, and is formed by a second mixing hole connecting the first mixing flow passage groove and the second gas flow passage groove to each other, the partition wall present between the second gas flow passage and the third mixing flow passage in the stacking direction is formed by a portion of the base substrate positioned between the second gas flow passage groove and the second mixing flow passage groove in the stacking direction, and an isolation wall present between the third mixing flow passage and the second cooling flow passage in the stacking direction is formed by a portion of the second substrate adjacent to the second mixing flow passage groove in the stacking direction.

14. The reliquefaction device according to claim 13, wherein the third mixing flow passage is adjacent to the second cooling flow passage through the isolation wall present between the third mixing flow passage and the second cooling flow passage in the stacking direction, is provided independently of the second cooling flow passage, and is connected to the downstream end portion of the first mixing flow passage to extend continuously from the first mixing flow passage, and the second cooling flow passage allows a flow of fluid cooling refrigerant such that reliquefaction of the second target gas contained in a gas-added fluid mixture flowing in the third mixing flow passage is promoted by cooling of the fluid mixture flowing in the third mixing flow passage by indirect heat exchange between the fluid mixture flowing in the third mixing flow passage and the fluid cooling refrigerant through the isolation wall.

15. The reliquefaction device according to claim 1, wherein the multiple flow passages have a serpentine shape as viewed in plan view.

* * * * *